United States Patent [19]

Ishimura

[11] Patent Number: 4,498,258

[45] Date of Patent: Feb. 12, 1985

[54] SPINDLE TILTING CONTROL DEVICE FOR A PLANE AND SPHERICAL ROTARY GRINDING MACHINE, FINE GRINDING MACHINE, LAPPING MACHINE AND POLISHING MACHINE

[76] Inventor: Yoshio Ishimura, 25-5 1-chome Shibayama, Funabashi-shi, Chiba-ken, Japan

[21] Appl. No.: 442,221

[22] PCT Filed: Mar. 10, 1981

[86] PCT No.: PCT/JP81/00053

§ 371 Date: Nov. 10, 1982

§ 102(e) Date: Nov. 10, 1982

[87] PCT Pub. No.: WO82/03039

PCT Pub. Date: Sep. 16, 1982

[51] Int. Cl.[3] ..... B24B 5/00

[52] U.S. Cl. ..... 51/131.3; 51/109 R; 51/126

[58] Field of Search ..... 51/131.3, 109 R, 110, 51/109 BS, 126

[56] References Cited

U.S. PATENT DOCUMENTS 4,318,250 3/1982 Klievoneit et al. ..... 51/134

*Primary Examiner*—Frederick R. Schmidt
*Assistant Examiner*—J. T. Zatarga
*Attorney, Agent, or Firm*—George B. Oujevolk

[57] ABSTRACT

A spindle tilting control device for a plane and spherical rotary grinding machine, fine grinding machine, lapping machine and polishing machine, which are super precise machines for manufacturing microminiature electronic part components, which device employs a joint (7) for tilting a spindle, can perpendicularly secure a rotary table (1) with respect to the spindle (3) by clamping crank bolts (4), (5), tilts a grindstone or surface plate (2) with a spindle tilting joint (7), thereby machining spherical surface together with electric and chemical methods. This machine can extremely precisely machine semiconductor material, magnetic material, ceramics, superhard alloys, or the like.

1 Claim, 2 Drawing Figures

SPINDLE TILTING CONTROL DEVICE FOR A PLANE AND SPHERICAL ROTARY GRINDING MACHINE, FINE GRINDING MACHINE, LAPPING MACHINE AND POLISHING MACHINE

FIELD OF THE ART

According to the advance of electronics, the development of semiconductors has remarkably progressed. It has been necessary to gradually miniaturize computers, microcomputers and office computers by the shift from miniaturization and precision to microminiaturization and super precision, namely the shift from transitors to ICs, ICs to LSIs and LSIs to super LSIs. Super precise machines have been required for producing these microminiature electronic part components.

This invention is to provide a spindle tilting control device for a plane and spherical rotary grinding machine, fine grinding machine, lapping machine and polishing machine, which device can machine these semiconductor materials such as silicon, magnetic materials such as ferrite and Sendust, ceramics and hard metals or the like, to a super precise planeness or sphericity.

BACKGROUND OF THE ART

These processing had been chiefly done by hands and depended on the skilled in the art. After a flat lapping machine was invented in the United States in 1919, several kinds of grinding machines, lapping machines and polishing machines have subsequently appeared, and the processings is now being in rapid progress of the mechanization.

DISCLOSURE OF THE INVENTION

A device of this invention is to provide improved models of a conventional plane and spherical rotary grinding machine, fine grinding machine, lapping machine and polishing machine and is developed in order to achieve a super precise plane and an extreme machining precision by freely tilting its spindle in four quarter directions.

BRIEF DESCRIPTION OF THE DRAWINGS

The drawings show an embodiment according to this invention.

Figures 1, 1A:
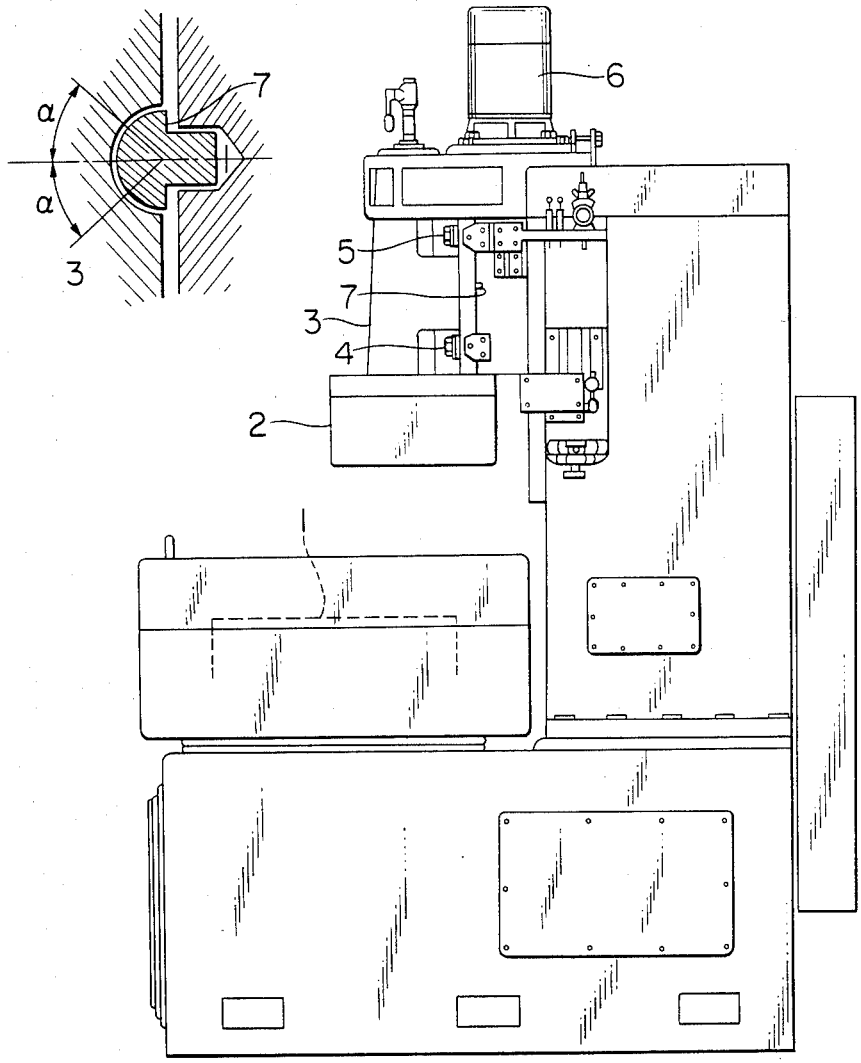
FIG. 1 is a right side view of a spindle tilting control device of this invention.
Figure 2:
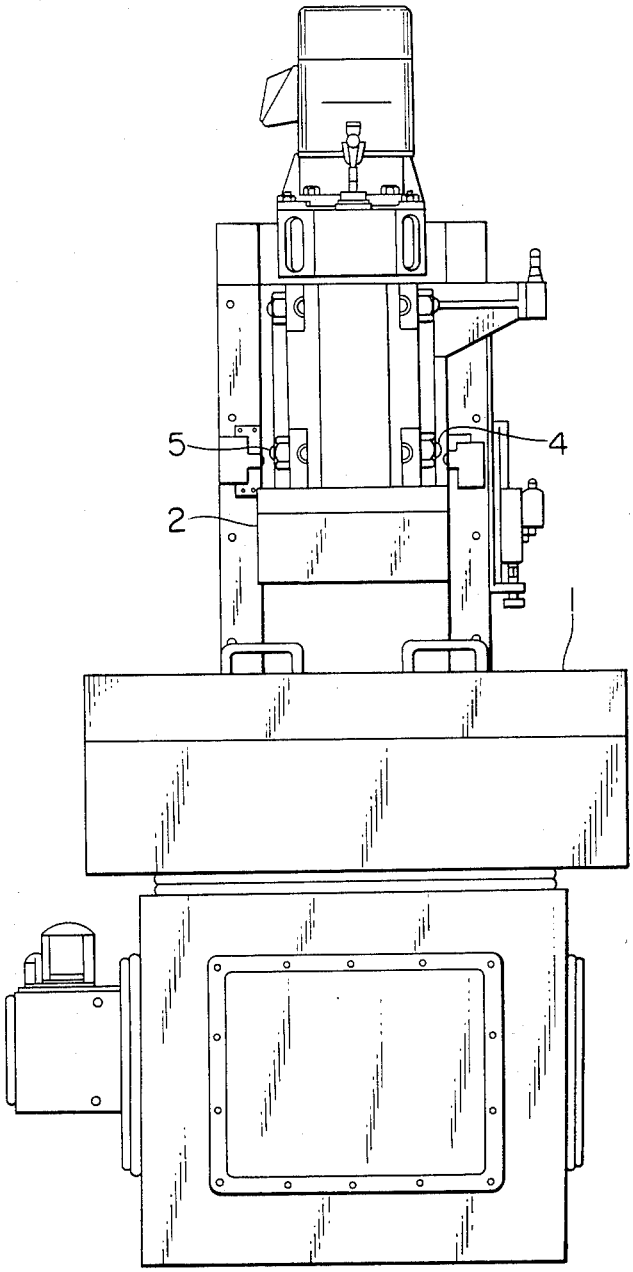
FIG. 2 is a front view of the spindle tilting control device of this invention.

In these drawings, numeral 1 represents a rotary table, numeral 2 represents a grindstone or surface plate, numeral 3 represents a spindle head, numeral 4 and 5 represent clamp bolts, numeral 6 represents a motor and numeral 7 represents a joint for tilting a spindle.

BEST FORM FOR WORKING THE INVENTION

The actions and effects of the device according to this invention will be explained with reference to these drawings, as follows.

Numeral 1 represents a rotary table for retaining a work magnetically or by vacuum and revolving the work, numeral 2 represents a grindstone or a lapping or polishing surface plate for grinding, lapping or polishing the work, numeral 3 represents a spindle head for revolving the grindstone or surface plate 2, numeral 4 and 5 represent clamp bolts for clamping on tilting the spindle head in one of four quarter directions or on setting the spindle completely perpendicular to the rotary table and numeral 6 represents a motor for driving a spindle head 3.

The device according to this invention is thus composed and can be used for a spherical grinding machine as the angle between the rotary table and a spindle shaft can be adjusted within a degree of angle $\alpha$ by tilting the spindle head 3 in one of four quarter directions with use of a joint 7 provided for tilting the spindle as illustrated in a detailed drawing in FIG. 1 differing from those in the conventional plane, spherical and rotary grinding machines, and also can achieve a complete planeness or sphericity of the work as the plane of the grindstone or the lapping or polishing surface plate and the plane of the rotary table can be kept completely in parallel to each other by setting the spindle completely perpendicular to the rotary table 1.

APPLICABILITY IN INDUSTRY

The device according to this invention will be required to be improved with a growing necessity for higher-grade machine tools for producing further extremely precise microminiature electronic part components, and the development for such improved machines is an urgent necessity.

I claim:

1. A rotary grinding machine, comprising:

(a) a machine bed with an upper horizontal part, a central vertical part, and a lower horizontal part, said central vertical part having a vertical wall;

(b) a rotary table (1) disposed for rotating in the horizontal plane disposed on said lower horizontal part, including magnetic or vacuum means to retain a workpiece;

(c) a vertical spindle and spindle head (3) alongside the central part of said frame disposed for holding a grindstone (2) so as to contact the workpiece which is to be placed on said rotary table, said spindle head usually rotating said grindstone in the horizontal plane, said spindle including a vertical plane section disposed parallel to said vertical wall;

(d) a joint (7) for holding said spindle plane section to said vertical wall, including a cylindrical shaft section penetrating said vertical wall and a hemispherical head section penetrating said plane section, said head section allowing rotation thereabout by said spindle in universal directions of about sixty degrees; and, (e) a motor (6) connected to said upper horizontal part, operatively coupled to said spindle to rotate the spindle.

* * * * *